US006503104B1

(12) United States Patent
Yuga et al.

(10) Patent No.: US 6,503,104 B1
(45) Date of Patent: Jan. 7, 2003

(54) ADAPTOR FOR CONNECTING BETWEEN TERMINALS WITH MULTIPLE PIECES

(75) Inventors: Tetsuo Yuga, Kanagawa; Shinichi Shiota, Tokyo, both of (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/009,690

(22) Filed: Jan. 20, 1998

(30) Foreign Application Priority Data

Jan. 20, 1997 (JP) ..... 09-008084

(51) Int. Cl.[7] ..... H01R 9/11
(52) U.S. Cl. ..... 439/623
(58) Field of Search ..... 439/623, 638, 439/639, 650, 654, 502, 578, 944

(56) References Cited

U.S. PATENT DOCUMENTS

| | | | | |
|---|---|---|---|---|
| 2,655,565 A | * | 10/1953 | Thompson | 369/11 |
| 4,236,779 A | | 12/1980 | Tang | 439/610 |
| 4,392,701 A | | 7/1983 | Weidler | 439/76.1 |
| 4,787,862 A | * | 11/1988 | Lee | 439/502 |
| 4,965,877 A | * | 10/1990 | Gunn | 363/146 |
| 4,981,438 A | * | 1/1991 | Bekhiet | 439/76.1 |
| 5,395,264 A | * | 3/1995 | Keith | 439/502 |

FOREIGN PATENT DOCUMENTS

| | | |
|---|---|---|
| DE | 31 33 810 | 3/1983 |
| DE | 33 31 616 | 4/1985 |
| FR | 2 763 752 | 11/1998 |

* cited by examiner

*Primary Examiner*—Steven L. Stephan
*Assistant Examiner*—Barry M. L. Standig
(74) *Attorney, Agent, or Firm*—Rader, Fishman & Grauer PLLC; Ronald P. Kananen

(57) ABSTRACT

An adaptor for a connector to be interposed between a first terminal unit having many contact pieces and a second terminal unit having many contact pieces that are used for input/output of a video signal, an audio signal, and a signal associated therewith. A first connecting portion has many contact pieces corresponding to the many contact pieces of the first terminal unit, respectively, and is so shaped as to be connectable to the first terminal unit. A second connecting portion has many contact pieces that correspond to the many contact pieces of the second terminal unit, respectively, and are connected to the respective contact pieces of the first connecting portion. The second connecting portion is so shaped as to be connectable to the second terminal unit. Conductive contact pieces are connected to predetermined ones of the many contact pieces of the first and second connecting portions, and are to be connected to pin plugs or pin jacks. Necessary signals can be supplied to another apparatus via the pin plugs or pin jacks that are connected to the conductive contact pieces.

45 Claims, 9 Drawing Sheets

FIG.1

21-CONTACT-PIECE TERMINAL FOR EUROPE
(EURO SCART TERMINAL)

| CONTACT PIECE NO. | COMMONLY USED FOR RECEIVER AND PERIPHERAL APPARATUS | |
|---|---|---|
| | RGB | Y / C |
| 1 | AUDIO OUTPUT B ( R ) | |
| 2 | AUDIO INPUT B ( R ) | |
| 3 | AUDIO OUTPUT A ( L ) | |
| 4 | AUDIO COMMON | |
| 5 | BLUE INPUT / OUTPUT | |
| 6 | AUDIO INPUT A ( L ) | |
| 7 | BLUE INPUT / OUTPUT | — |
| 8 | FUNCTION SWITCH | |
| 9 | GREEN INPUT / OUTPUT | |
| 10 | ( RESERVED FOR CONTROL SIGNAL ) | |
| 11 | GREEN INPUT / OUTPUT | — |
| 12 | | |
| 13 | RED INPUT / OUTPUT | |
| 14 | BLANKING | |
| 15 | RED INPUT / OUTPUT | — |
| | — | CHROMA ( C ) INPUT |
| 16 | BLANKING | — |
| 17 | VIDEO OUTPUT | |
| 18 | VIDEO INPUT | |
| 19 | VIDEO OUTPUT | |
| 20 | VIDEO INPUT | — |
| | — | LUMINANCE ( Y ) SIGNAL |
| 21 | PLUG SHIELD COMMON | |

ADAPTOR FOR CONNECTING BETWEEN TERMINALS WITH MULTIPLE PIECES

BACKGROUND OF THE INVENTION

The present invention relates to an adaptor and a connector that are used for connection of audio-visual apparatuses such as a television receiver, a video tape recorder, and an audio-visual amplifier.

In Europe, audio-visual apparatuses (hereinafter abbreviated as "AV apparatuses") such as a television receiver and a video tape recorder (hereinafter abbreviated as "VTR") are often equipped with a EURO SCART terminal, which is a terminal unit for Europe having 21 contact pieces, to enable input/output of video signals, audio signals, and signals associated therewith. The EURO SCART terminal was developed to enable AV apparatuses to be connected to each other easily.

The EURO SCART terminal is standardized and its 21 contact pieces are respectively assigned signals to be handled as shown in FIG. 1. Therefore, for example, a television receiver and a VTR each having a EURO SCART terminal can easily be connected to each other with an adaptor for a connector or a connector cable having connecting portions that conform to the EURO SCART terminal.

That is, a television receiver and a VTR each having a EURO SCART terminal (terminal unit) can be connected to each other and input/output of video signals and audio signals are enabled merely by making connections to the EURO SCART terminals without the need for separately connecting, on a terminal-by-terminal basis, input terminals and output terminals of video signals and those of audio signals that are provided in the television receiver and the VTR. Therefore, the television receiver and the VTR can be connected to each other reliably and easily without causing an event that input terminals are erroneously used as output terminals or vice versa.

Further, as shown in FIG. 1, when AV apparatuses such as a television receiver and a VTR are connected to each other via EURO SCART terminals, not only video signals and audio signals but also signal associated therewith can be input and output.

For example, the 8th contact piece of the EURO SCART terminal is used for input/output of a function switch signal. This enables a simplified manipulation; for example, when a VTR is turned on, a television receiver is informed of the turning-on of the VTR via the 8th contact pieces of the EURO SCART terminals and is then automatically turned on.

There is a plan of using the 9th contact piece to enable input/output of a control signal; attempts to simplify manipulation, such as controlling, in link with each other, AC apparatuses that are connected to each other via EURO SCART terminals, are now going on.

By the way, in recent years, in viewing and listening to a television program or a picture and sound that are obtained by playing back a video tape in homes, an audio-visual amplifier (hereinafter abbreviated as "AV-amplifier") is provided between a television receiver and a VTR and audio signals that are output from the television receiver or the VTR are supplied to, for instance, surround speakers via the AV amplifier, to obtain presence in a home theater or a movie theater.

However, it is not easy to connect such an apparatus as an AV amplifier between a television receiver and a VTR by using the above-described EURO SCART terminals. Even if the connections are made, there may occur some problems.

As described above, the EURO SCART terminal was developed to enable two AV apparatuses, such as a television receiver and a VTR, to be connected to each other easily with a simple manipulation, and no consideration is given to additional devices, as an AV amplifier, that is to be connected between the television receiver and the VTR.

Usually, to view and listen to a picture and sound that are reproduced from a VTR, in a case where an AV amplifier is connected between a television receiver and the VTR by using EURO SCART terminals, a conversion adaptor for extracting only necessary video and audio signals from the EURO SCART terminals is needed.

The conversion adaptor is connected to the EURO SCART terminal of the VTR, and video signals are supplied to the television receiver while audio signals are supplied to the AV amplifier. With these connections, a picture that is reproduced by the VTR is displayed on the television receiver while sound that is reproduced by the VTR is output from surround speakers, for instance.

However, in this case, the VTR is allowed to output only the video signals and audio signals; the VTR is not allowed to output any associated signals, such as a signal that should be output from the VTR via the 8th contact piece as described above (function switch signal). Therefore, it is no longer possible to perform such a control as automatically turning on the television receiver that is in a state of not being supplied with power.

To supply audio signals that are output from the VTR also to the television receiver to cause the speakers of the television receiver to output sound, additional measures are needed, such as making further connections between the AV amplifier and the television receiver, thereby allowing audio signals that are supplied to the AV amplifier to be supplied from the AV amplifier to the television receiver. However, this is not preferable because the connections between the AV apparatuses become complex and a connecting operation takes much time and labor.

To cause the AV amplifier to output audio signals coming from the television receiver, it is necessary to use a conversion adaptor for extracting only necessary audio signals from the EURO SCART terminal of the television receiver and to supply the extracted audio signals to the AV amplifier. Further, more complicated connections are needed to record a television program or the like by supplying video and audio signals from the television receiver to the VTR.

SUMMARY OF THE INVENTION

In view of the above, an object of the invention is to provide an adaptor for a connector and a connector which enable connection of another audio-visual apparatus between audio-visual apparatuses by using a multiple-contact-piece terminal that is designed to make connection between AV apparatuses and is used for input/output of plural kinds of signals, without impairing the functions of the multiple-contact-piece terminal.

To solve the above problems, the invention provides an adaptor for a connector to be interposed between a first terminal unit having multiple contact pieces and a second terminal unit having multiple contact pieces that are used for input/output of a video signal, an audio signal, and a signal associated therewith, comprising a first connecting portion that has multiple contact pieces corresponding to the multiple contact pieces of the first terminal unit, respectively, and that is so shaped as to be connectable to the first terminal unit; a second connecting portion that has many contact pieces corresponding to the multiple contact pieces of the second terminal unit, respectively, and connected to the respective contact pieces of the first connecting portion, and that is so shaped as to be connectable to the second terminal unit; and a conductive contact piece connected to a predetermined one of the multiple contact pieces of the first and second connecting portions, and being connectable to a pin plug or a pin jack.

The invention also provides a multiple-contact-piece connector for input/output of a video signal, an audio signal, and a signal associated therewith, comprising a plug portion or jack portion having many contact pieces; a cable portion having a number of signal lines that are connected to the respective multiple contact pieces of the plug portion or jack portion; and conductive contact piece connected to predetermined one of the multiple contact pieces of the plug portion or jack portion, and to be connected to a pin plug or a pin jack.

According to the adaptor of the invention, all signals that are input from the multiple-contact-piece plug portion side are output to the multiple-contact piece jack portion side and all signals that are input from the jack portion side are output to the plug portion side. Where conductive contact pieces are connected to the contact pieces for handling audio signals, audio signals that are input/output between the plug portion and the jack portion are also output from the conductive contact pieces.

As a result, all signals that are handled by all contact pieces can be input/output between an AV apparatus that is connected to the plug portion side of the adaptor that conforms to the EURO SCART terminal and an AV apparatus that is connected to the jack portion side, as well as audio signals can be supplied to another AV apparatus, such as an AV amplifier.

According to the connector of the invention, signal lines are connected to the respective contact pieces of the multiple-contact-piece plug portion or jack portion, whereby all signals handled by the respective contact pieces can be input and output. Where conductive contact pieces are connected to the contact pieces for handling audio signals, audio signals that are input/output via the connector are also output via the pin plugs or pin jacks.

As a result, where AV apparatuses are connected to each other by using this connector, all signals that are handled by all contact pieces can be input/output between the connected AV apparatuses, as well as audio signals can be supplied to an AV amplifier, for instance, as in the case of using the adaptor of the invention.

BRIEF DESCRIPTION OF THE DRAWINGS

FIG. 1 shows a correspondence between the contact pieces of a 21-contact-piece terminal for Europe (EURO SCART terminal) and signals to be handled by the respective contact pieces;

DETAILED DESCRIPTION OF THE PREFERRED EMBODIMENTS

Adaptors for a connector and a connector according to embodiments of the present invention will be hereinafter described with reference to the drawings. The adaptors for a connector and the connector of the invention will be described below as ones that conform to the above-described, so-called EURO SCART terminal that is a 21-contact piece terminal for Europe which is used for enabling AV apparatuses to be easily connected to each other and connected AV apparatuses to be controlled in link with each other.

Embodiment 1

FIGS. 2A–2C and 3 show an adaptor 10 for a connector according to a first embodiment of the invention. The adaptor 10 for a connector of the first embodiment is used for connecting, for instance, a television receiver and a VTR as well as connecting those to an AV amplifier for allowing audio signals that are output from the television receiver or the VTR to be output from external speakers.

As shown in a top view of FIG. 2B, in the adaptor 10 of the first embodiment, a body 1 is provided with a plug portion (connecting portion) 2, a jack portion (connecting portion) 3, and pin jacks 41–44 (conductive contact pieces; described later in detail) that constitute audio signal output terminal ends.

Figure 2A:
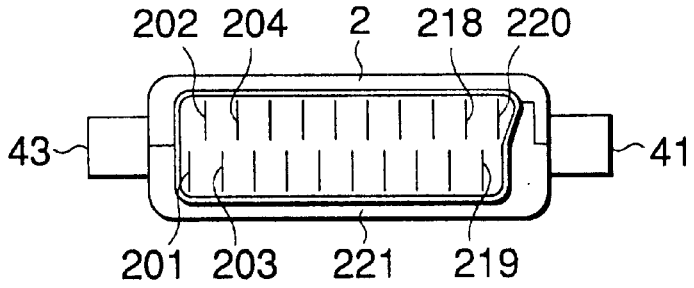
FIGS. 2A–2C show an adaptor according to a first embodiment of the present invention.

As shown in FIG. 2A, the plug portion 2 has 20 plug contact pieces 201–220 formed by punching out a metal plate and one shield shell contact piece 221 that correspond to the 21 contact pieces, respectively. The shield shell contact piece 221 is a ring-like metal contact piece that surrounds the plug contact pieces 201–220 to shield them electrostatically.

Figure 2B:
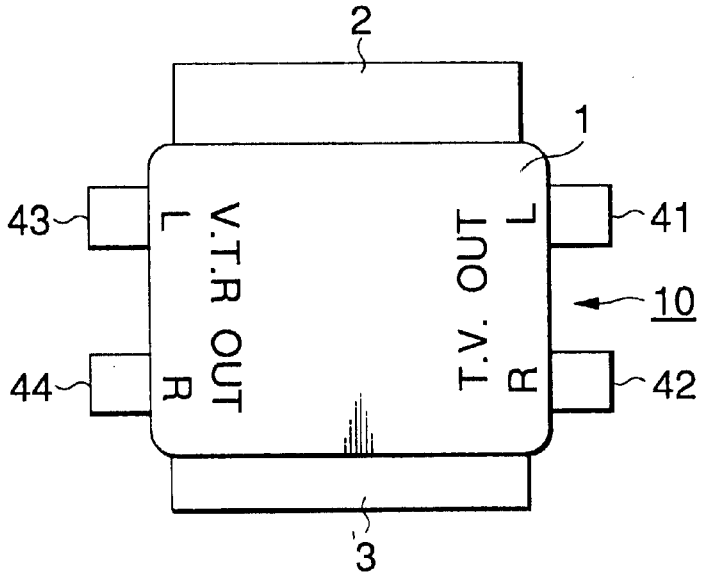
Figure 2C:
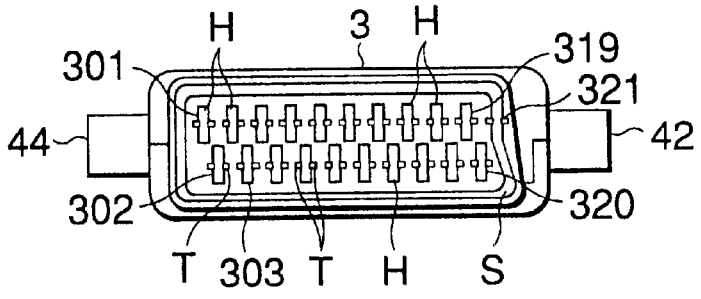

As shown in FIG. 2C, the jack portion 3 has 20 jack contact pieces 301–320 in each of which a forked conductive piece T is provided in a fitting hole H. A jack contact piece 321 is for shielding. A ring-like groove S surrounds the jack contact pieces 301–320. In the jack contact piece 321, a forked conductive piece T is provided so as to cross the ring-like groove S. A shield ring-like metal contact piece of a connector plug 51 (described later) is to be fitted into the ring-like groove S.

Figure 3:
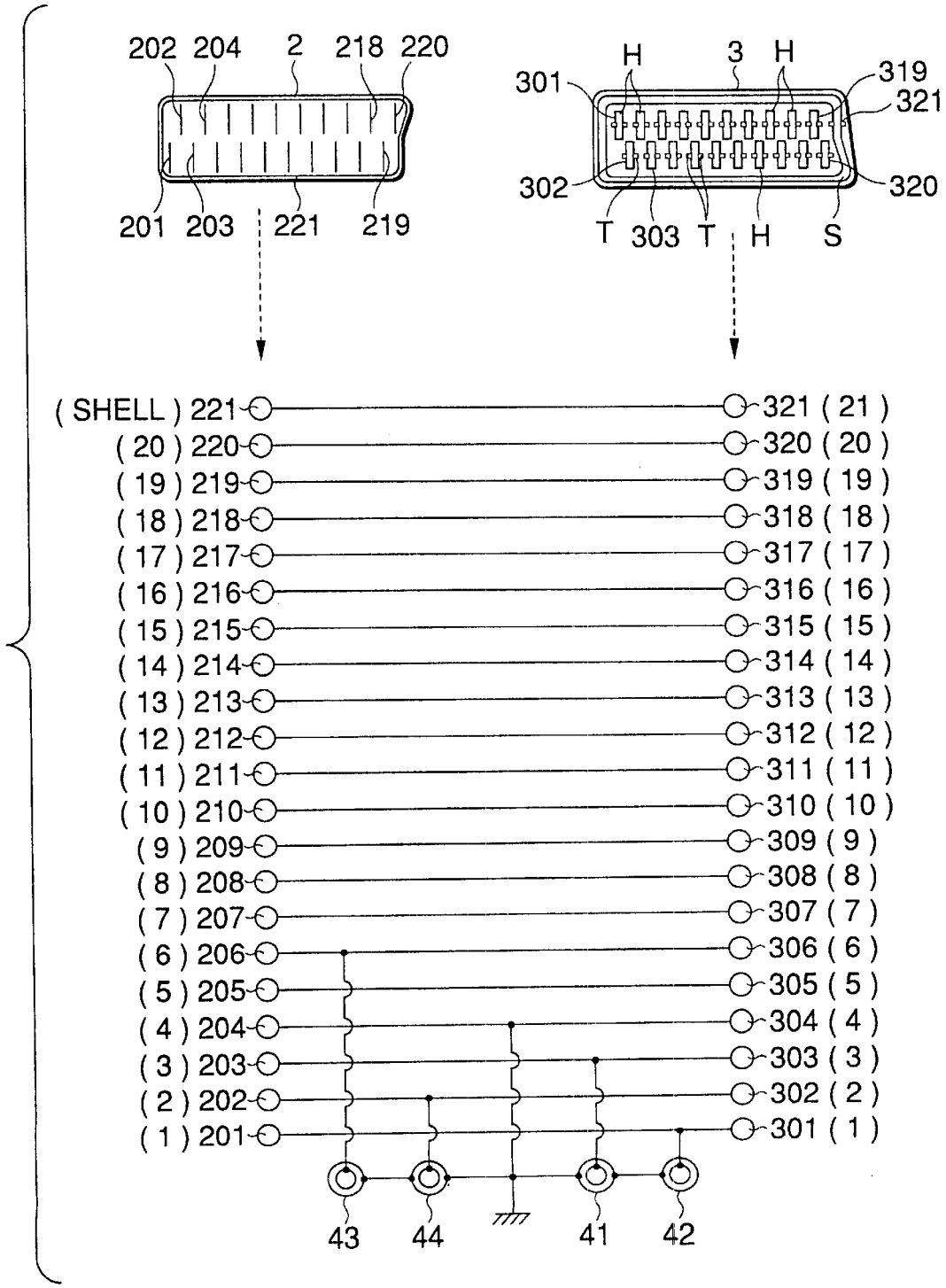
FIG. 3 shows connections inside the adaptor of FIGS. 2A–2C.

As shown in FIG. 3, all of the plug contact pieces 201–221 of the plug portion 2 are connected to the respective jack contact pieces 301–321 of the jack portion 3. With this structure, signals that are input from the plug portion 2 side are output, as they are, to the jack portion 3 side, and signals that are input from the jack portion 3 side are output from the plug portion 2 side.

As mentioned above, the adaptor 10 of the first embodiment conforms to the 21-contact-piece terminal for Europe (EURO SCART terminal) which is standardized such that signals to be handled by the 21 respective contact pieces are determined as shown in FIG. 1.

In the adaptor 10 of the first embodiment, the body 1 is provided with the pin jacks 41–44 (conductive contact pieces) that are audio signal output terminals connected to the contact pieces for handing audio signals at the positions between the plug portion 2 and the jack portion 3.

As shown in FIG. 3, the audio signal pin jacks 41–44 are connected to the contact pieces for handling audio signals that are output from a television receiver or the contact pieces for handling audio signals that are supplied from a VTR to a television receiver. In FIG. 3, the parenthesized numbers correspond to the contact piece numbers shown in FIG. 1.

The first embodiment is directed to a case where the plug portion 2 of the adaptor 10 is fitted in a terminal unit that constitutes the EURO SCART terminal of a television receiver.

Therefore, in the first embodiment, the pin jack 41 is connected so as to lead out, among stereo audio signals to be output from the television receiver, a left (L) channel audio signal that is handled by the plug contact piece 203 and the jack contact piece 303. The pin jack 42 is connected so as to lead out, among stereo audio signals to be output from the television receiver, a right (R) channel audio signal that is handled by the plug contact piece 201 and the jack contact piece 301.

The pin jack 43 is connected so as to lead out, among stereo audio signals to be supplied from the VTR to the television receiver, a left (L) channel audio signal that is handled by the plug contact piece 206 and the jack contact piece 306. The pin jack 44 is connected so as to lead out, among stereo audio signals to be supplied from the VTR to the television receiver, a right (R) channel audio signal that is handled by the plug contact piece 202 and the jack contact hole 302.

With the above structure, the pin jacks 41 and 42 output audio signals that are output from the television receiver, and the pin jacks 43 and 44 output audio signals that are reproduced by the VTR and to be input to the television receiver.

Therefore, when a television receiver and a VTR, each having a EURO SCART terminal unit, are connected to each other by using the adaptor 10 of the first embodiment, audio signals that are output from the audio signal pin jacks 41–44 can also be supplied to an AV amplifier.

Figure 4:
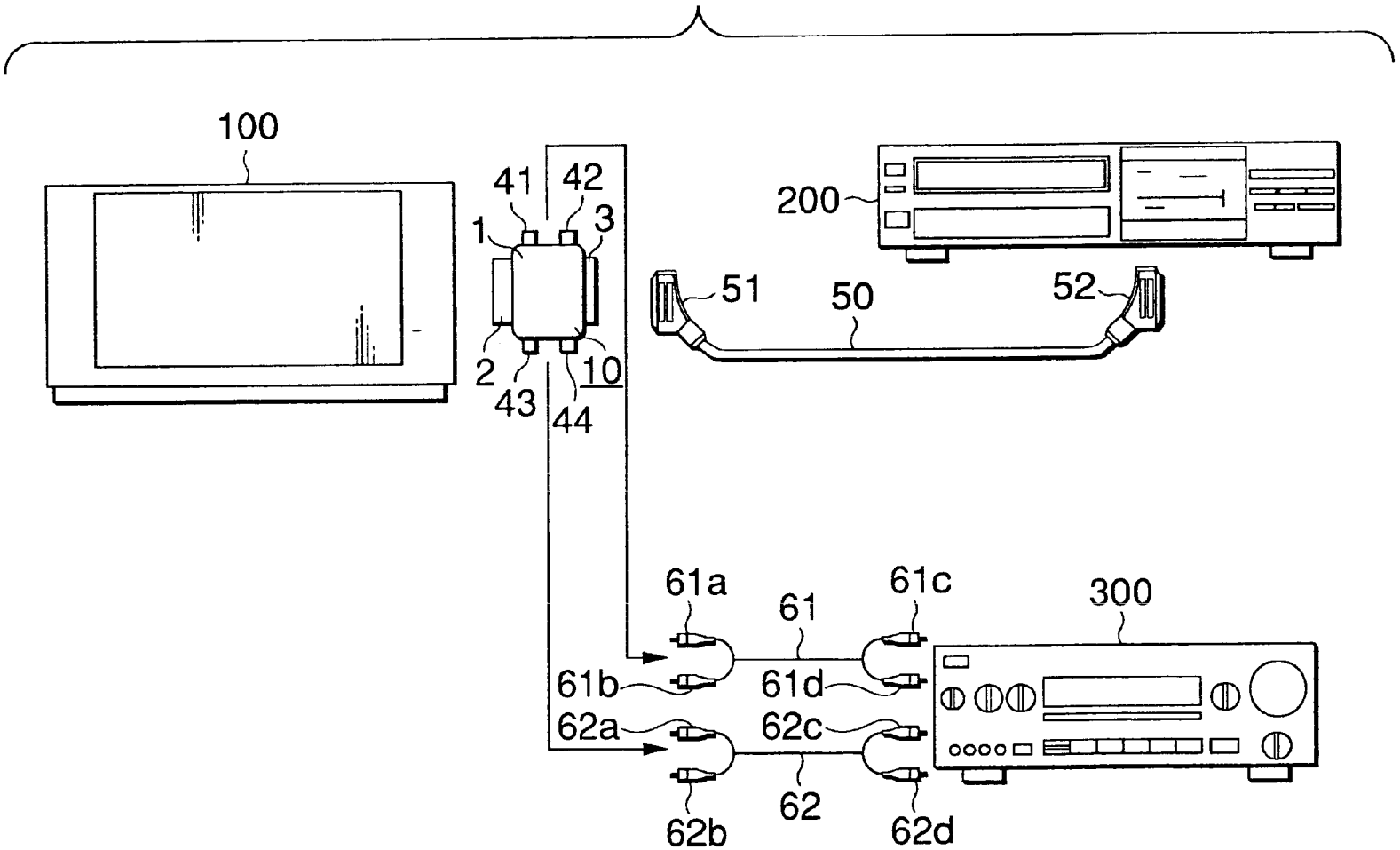
FIG. 4 shows how AV apparatuses are connected to each other by using the adaptor of FIGS. 2A–2C.

FIG. 4 shows how a television receiver 100, a VTR 200, and an AV amplifier 300 are connected to each other by using the adaptor 10 of the first embodiment.

In the first embodiment, as shown in FIG. 4, the plug portion 2 (connecting portion) of the adaptor 10 is attached to, i.e., fitted in, the EURO SCART terminal unit that is provided in the television receiver 100. The jack portion 3 (connecting portion) of the adaptor 10 is connected to the EURO SCART terminal unit that is provided in the VTR 200 via a connector cable 50 as in the conventional case. That is, a connector plug 51 of the connector cable 50 is connected to the jack portion 3 (connecting portion) of the adaptor 10, and a connector plug 52 of the connector cable 50 is connected to the EURO SCART terminal unit of the VTR 200.

The EURO SCART terminal unit provided in each of the television receiver 100 and the VTR 200 has a jack structure with a contact piece layout obtained by removing the pin jacks 42 and 44 from the jack portion 3 shown in FIG. 2C.

As for the connection between the plug portion and the jack portion of the EURO SCART terminal units, the plug contact pieces of the plug portion of the EURO SCART terminal unit are inserted into the respective fitting holes H of the jack portion of the EURO SCART terminal unit, that is, each plug contact piece is inserted between the two branches of the forked conductive piece T that face the fitting hole H. The plug contact pieces are thus electrically connected to the respective jack contact pieces. At this time, the ring-like metal contact piece of the plug portion of the EURO SCART terminal unit is fitted into the ring-like groove of the jack portion of the EURO SCART terminal unit, whereby the ring-like metal contact piece is electrically connected to the jack contact piece 321 of the EURO SCART terminal unit.

With the above connections, all signals to be handled by all of the 21 contact pieces of the EURO SCART terminals can be input/output between the television receiver 100 and the VTR 200.

Further, the pin jacks 41 and 42 that are provided in the adaptor 10 of the first embodiment are connected to audio input pin jacks (not shown) of the AV amplifier 300 by using a connection cable 61 that has pin plugs 61*a* and 61*b* on one end and pin plugs 61*c* and 61*d* on the other end, whereby audio signals that are output from the TV receiver 100 can be supplied to the AV amplifier 300. Similarly, the pin jacks 43 and 44 are connected to audio input pin jacks (not shown) of the AV amplifier 300 by using a connection cable 62 that has pin plugs 62*a* and 62*b* on one end and pin plugs 62*c* and 62*d* on the other end, whereby audio signals that are output from the VTR 200 can be supplied to the AV amplifier 300.

In the above manner, the adaptor 10 of the first embodiment allows the television receiver 100 and the VTR 200, each having what is called the EURO SCART terminal unit, to be connected to each other by using the EURO SCART terminals without impairing the functions of the EURO SCART terminals, and also allows the AV amplifier 300 to be connected between the TV receiver 100 and the VTR 200.

As a result, audio signals that are output from each of the television receiver 100 and the VTR 200 that are connected to each other with the EURO SCART terminals can be supplied to the AV amplifier 300, thereby enabling external speakers, such as surround speakers that are connected to the AV amplifier 300, to output sound.

Therefore, there can be eliminated the complexities in the connections of a connection cable for connecting the devices, which require undue time and labor for the connections. The invention also eliminates the problem where associated signals cannot be input or output to disable the devices to be controlled in link with each other, inconveniences, which occur when using the above-mentioned, so-called conversion adaptor for enabling only necessary signals to be output from a EURO SCART terminal. That is, it becomes possible to easily connect multiple electronic apparatuses such as a television receiver, a VTR, and an AV amplifier by using EURO SCART terminals without impairing the functions of the EURO SCART terminals.

Embodiment 2

Next, an adaptor 20 according to a second embodiment of the invention will be described. As in the case of the adaptor 10 of the first embodiment, the adaptor 20 of the second embodiment conforms to what is called the EURO SCART terminal.

In the above-described adaptor 10 of the first embodiment, as shown in FIG. 2B, the pin jacks 41–44 as audio output terminals are provided in the body 1 of the adaptor 10. Therefore, as shown in FIG. 4, such an apparatus as an AV amplifier can be connected between the television receiver 100 and the VTR 200 by using the connection cables 61 and 62 when necessary.

However, certain types of television receivers and VTRs having a EURO SCART terminal are provided with other terminals or various switches in the vicinity of the EURO SCART terminal. If an AV amplifier or the like is connected to such an apparatus by using the adaptor 10 of the first embodiment, there may occur a case that the terminals or switches in the vicinity of the EURO SCART terminal cannot be used because they are obstructed by the pin plug portions of the connection cables that are connected to the pin jacks 41–44 as audio signal output terminals that are provided in the body 1 of the adaptor 10.

In the adaptor 20 of the second embodiment, to avoid obstructing the use of the terminals or switches in the vicinity of the EURO SCART terminal of a television receiver or a VTR, a cable is provided to extend from the body of the adaptor 20, and pin plugs to be inserted in the pin jacks of an AV amplifier are provided at the end of the cable.

Figure 5:
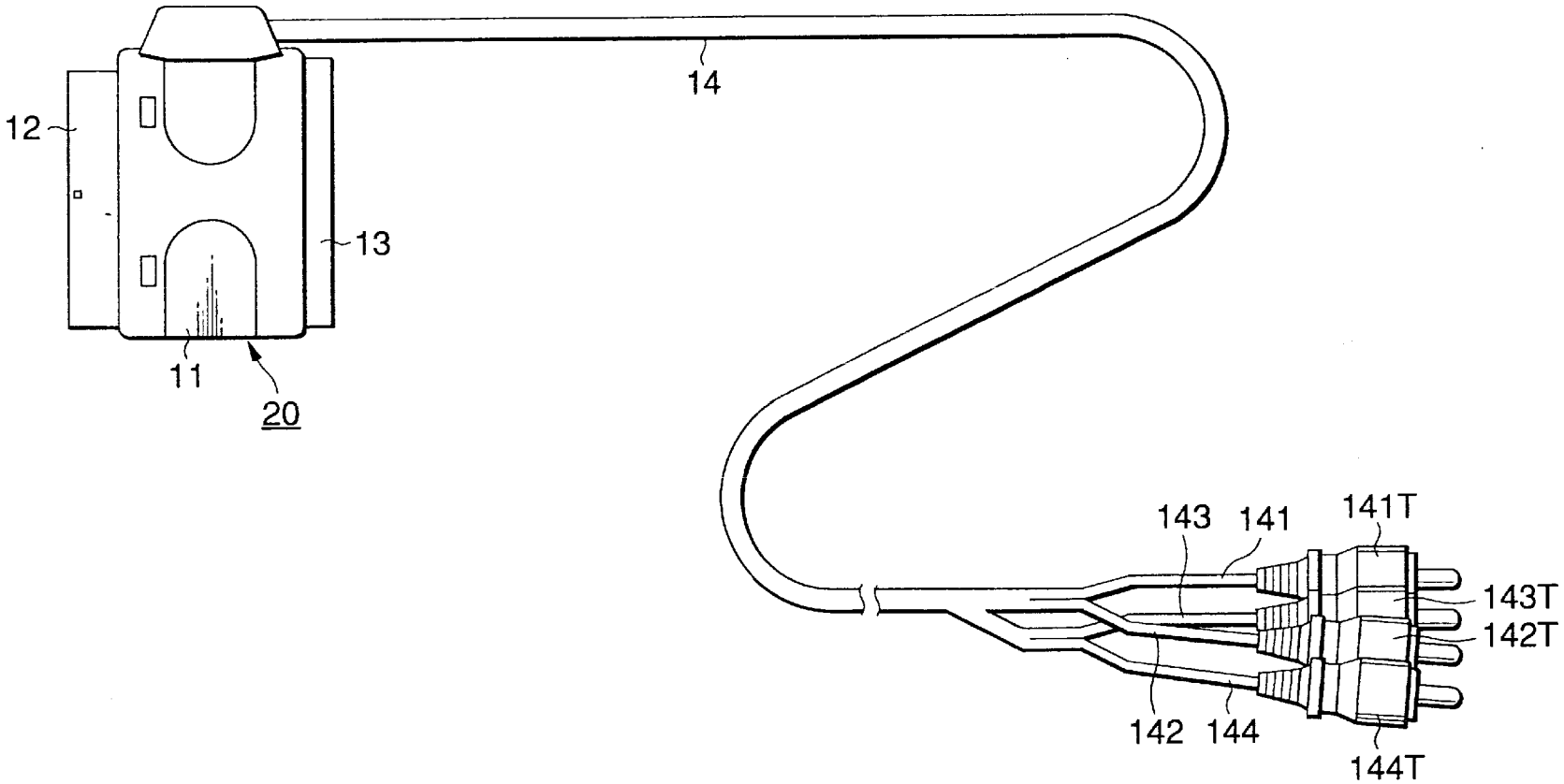
FIG. 5 shows an adaptor according to a second embodiment of the invention.

FIGS. 5, 6A–6D, and 7 show the adaptor 20 of the second embodiment. As shown in FIG. 5, in the adaptor 20 of the second embodiment, a body 11 is provided with a plug portion 12 and a jack portion 13 in the same manner as in the above-described adaptor 10 of the first embodiment. As shown in a bottom view (FIG. 6B) and a top view (FIG. 6D) of the adaptor portion of the second embodiment, the plug portion 12 and the jack portion 13 are provided so as to be opposed to each other with the body 11 interposed in between.

In the adaptor 20 of the second embodiment, the plug portion 12 and the jack portion 13 are configured in the same manner as the plug portion 2 and the jack portion 3 of the adaptor 10 of the first embodiment.

Figure 6A:
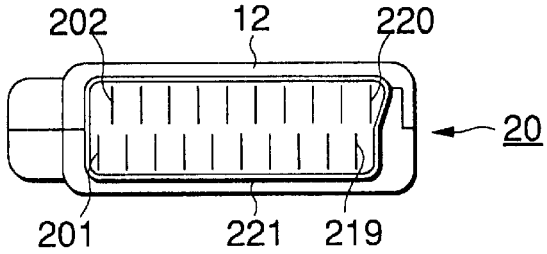
FIGS. 6A–6D show an adaptor portion of the adaptor of FIG. 5.
Figure 6B:
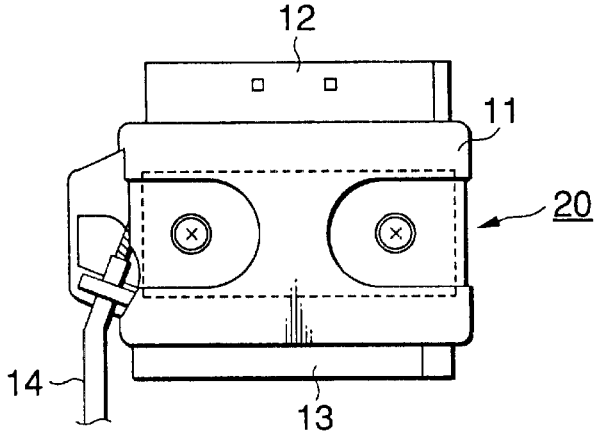
Figure 6C:
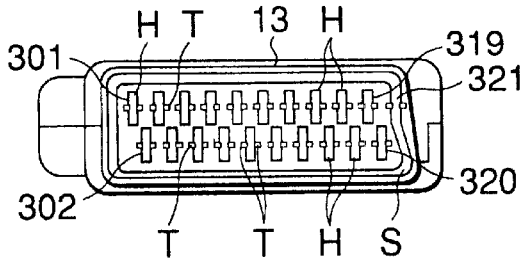
Figure 6D:
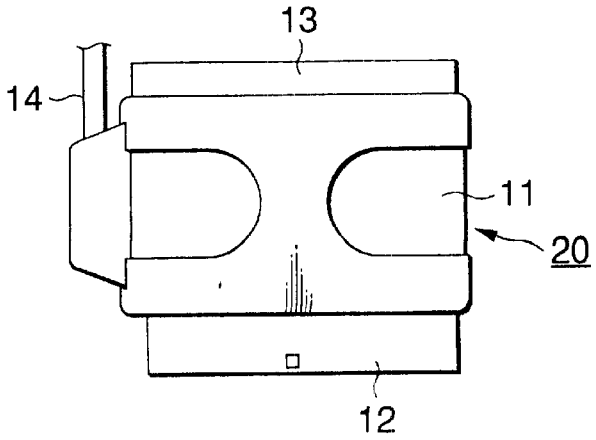

That is, as shown in FIG. 6A, the plug portion 12 has 20 conductive plug pieces 201–220 and one ring-like shield shell contact piece 221. As shown in FIG. 6C, the jack portion 13 has 21 conductive jack contact pieces 301–321 that are connected to the respective plug pieces 201–221 of the plug portion 12 by conductive wires.

Since the 21 plug contact pieces 201–221 of the plug portion 12 and the 21 jack contact pieces 301–321 of the jack portion 13 are connected to each other, respectively, signals that are input from the plug portion 12 side are output to the jack portion 13 side and signals that are input from the jack portion 13 side are output to the plug portion 12 side.

The adaptor 20 of the second embodiment further has a cable 14 that are connected, between the plug portion 12 and the jack portion 13, to the contact pieces for handling audio signals, and that extends outward from the body 11.

The cable 14 is configured such that four cables 141–144 for handling, in the same manner as the above-described pin jacks 41–44 of the first embodiment as the audio signal output terminals, audio signals of the left (L) and right (R) channels that are output from a television receiver and audio signals of the left (L) and right (R) channels that are output from a VTR are covered together.

Figure 7:
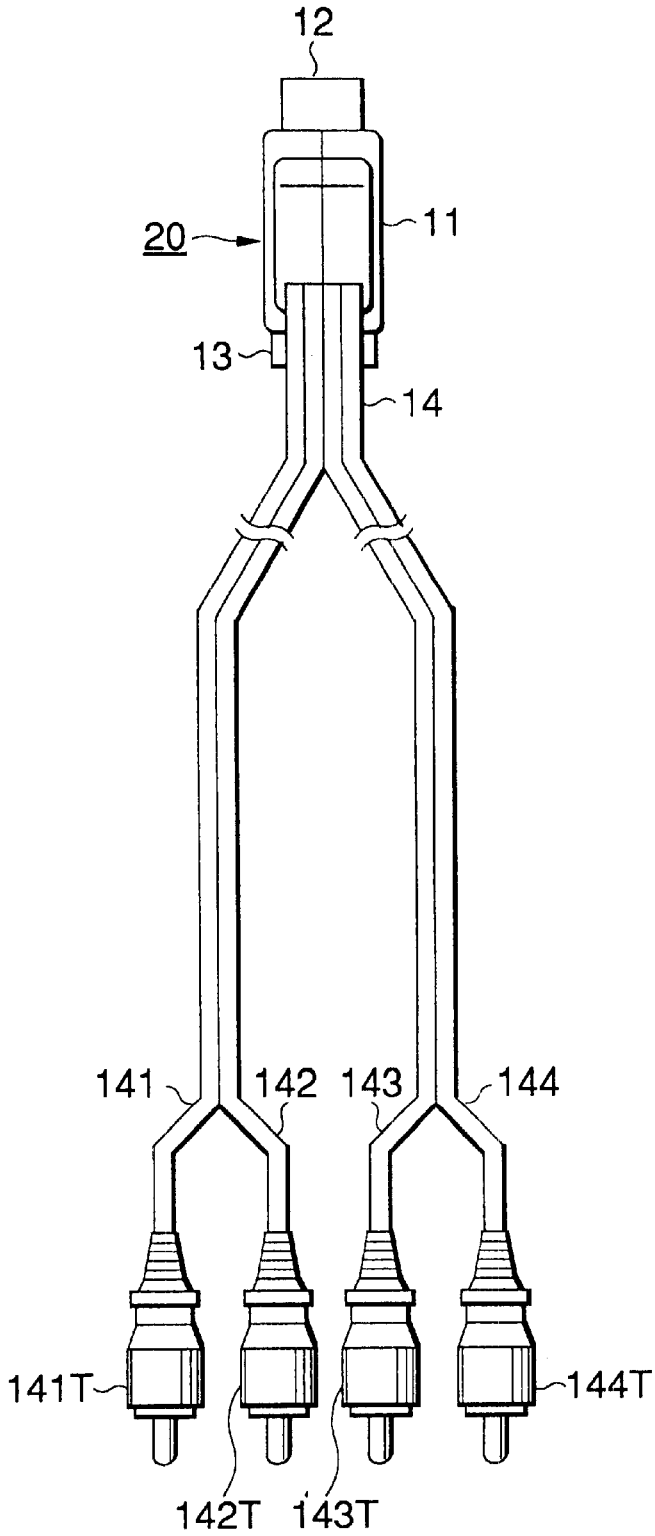
FIG. 7 shows a cable portion that extends from a body of the adaptor of FIG. 5.

FIG. 7, which is a side view corresponding to FIG. 5, shows the cable 14 that extends from the body 11 of the adaptor 20 of the second embodiment. As shown in FIG. 7, the four cables 141–144 extend from the body 11 and pin plugs 141T–144T as output terminals are provided at the tips of the respective cables 141–144.

In the adaptor 20 of the second embodiment, the plug contact pieces 201–221, the jack contact pieces 301–321, etc. are the same as those of the adaptor 10 of the first embodiment. The pin plugs 141T–144T correspond to the pin jacks 41–44 as the output terminals of the first embodiment.

Therefore, the cable 141 is connected so as to lead out a left (L) channel audio signal to be handled by the plug contact piece 203 and the jack contact piece 303 among stereo audio signals to be output from the television receiver. The cable 142 is connected so as to lead out a right (R) channel audio signal to be handled by the plug contact piece 201 and the jack contact piece 301 among stereo audio signals to be output from the television receiver.

The cable 143 is connected so as to lead out a left (L) channel audio signal to be handled by the plug contact piece 206 and the jack contact piece 306 among stereo audio signals to be supplied from the VTR to the television receiver. The cable 144 is connected so as to lead out a right (R) channel audio signal to be handled by the plug piece 202 and the jack portion 302 among stereo audio signals to be supplied from the VTR to the television receiver.

With the above connections, the pin plugs 141T and 142T output, via the cables 141 and 142, audio signals that are output from the television receiver. The pin plugs 143T and 144T output, via the cables 143 and 144, audio signals that are reproduced by the VTR and to be input to the television receiver.

Therefore, when a television receiver and a VTR, each having a EURO SCART terminal unit, are connected to each other by using the adaptor 20 of the second embodiment, audio signals can also be supplied to an AV amplifier via the cables 141–144 and the pin plugs 141T–144T as the output terminals connected to the cables 141–144.

Figure 8:
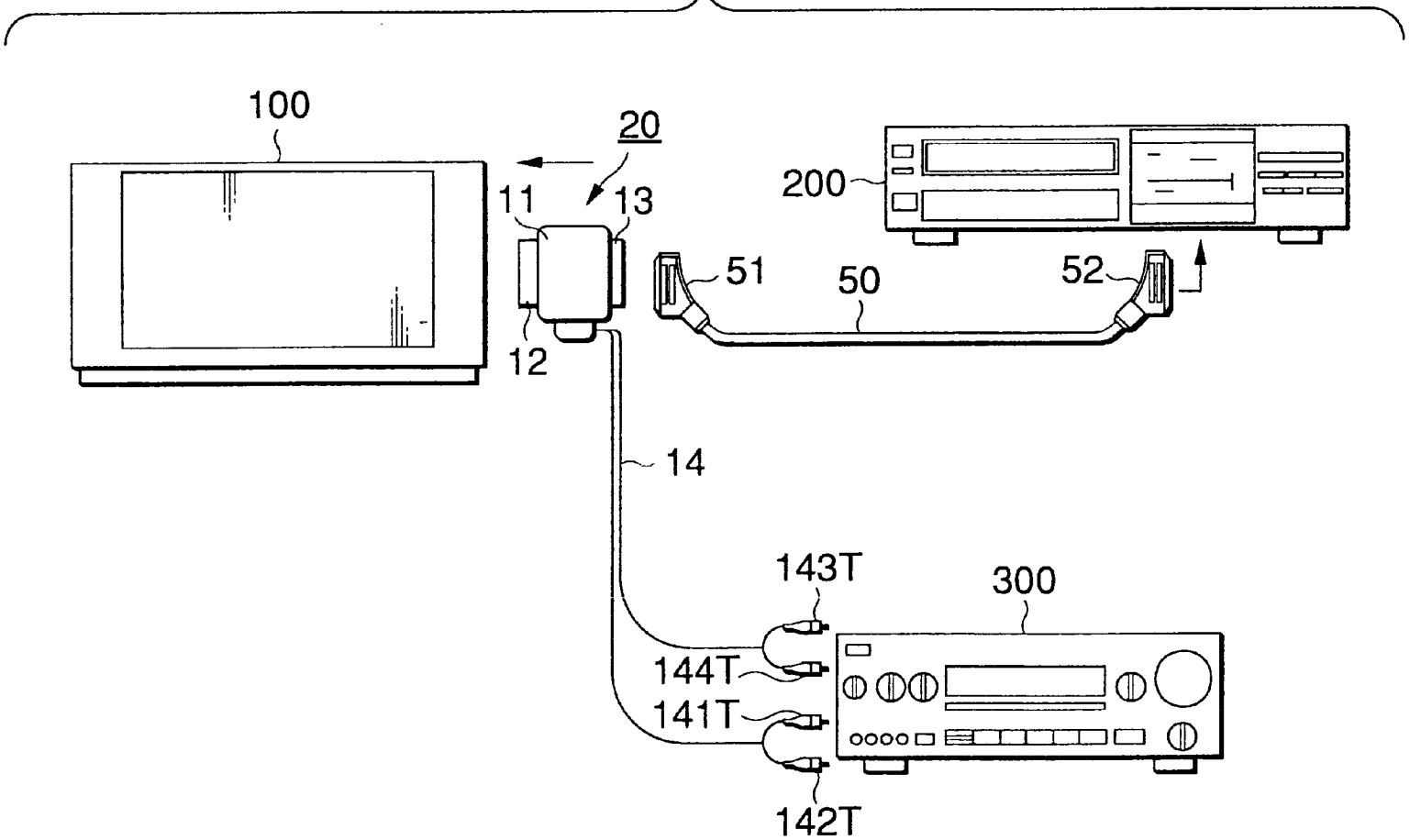
FIG. 8 shows how AV apparatuses are connected to each other by using the adaptor of FIG. 5.

FIG. 8 shows how a television receiver 100, a VTR 200, and an AV amplifier 300 are connected to each other by using the adaptor 20 of the second embodiment.

As shown in FIG. 8, in the case of using the adaptor 20 of the second embodiment, the plug portion 12 of the adaptor 20 is attached to, i.e., fitted in, the EURO SCART terminal unit that is provided in the television receiver 100 in the same manner as in the case of using the adaptor 10 of the first embodiment. The jack portion 13 of the adaptor 20 is connected to the EURO SCART terminal that is provided in the VTR 200 via a connector cable 50 as in the case of FIG. 4.

With the above connections, all signals to be handled by all of the 21 contact pieces of the EURO SCART terminals can be input/output between the television receiver 100 and the VTR 200.

Further, the pin plugs 141T and 142T that are provided at the ends of the cables 14 extending from the adaptor 20 of the second embodiment are inserted in and connected to audio input pin jacks of the AV amplifier 300, whereby audio signals that are output from the TV receiver 100 can be supplied to the AV amplifier 300.

Similarly, the pin plugs 143T and 144T that are provided at the tips of the cables 14 extending from the adaptor 20 of the second embodiment are inserted in and connected to audio input pin jacks of the AV amplifier 300, whereby audio signals that are output from the VTR 200 can be supplied to the AV amplifier 300.

As described above, the adaptor 20 of the second embodiment allows the television receiver 100 and the VTR 200, each having the EURO SCART terminal unit, to be connected to each other by using the EURO SCART terminals without impairing the functions of the EURO SCART terminals, as well as allows the AV amplifier 300 to be connected between the TV receiver 100 and the VTR 200.

As a result, audio signals that are output from each of the television receiver 100 and the VTR 200 that are connected to each other by using the adaptor 20 for the EURO SCART terminal can be supplied to the AV amplifier 300, thereby enabling external speakers such as surround speakers that are connected to the AV amplifier 300 to output sound.

Therefore, as in the case of using the above-described adaptor 10 of the first embodiment, the invention eliminates complexity in the connections of a connection cable for connecting the apparatuses concerned, which require undue time and labor for the connections and where associated signals cannot be input or output to disable the apparatuses concerned to be controlled in link with each other. That is, it becomes possible to connect electronic apparatuses such as a television receiver, a VTR, and an AV amplifier by using EURO SCART terminals without impairing the functions of the EURO SCART terminals.

Further, in the case of the adaptor 20 of the second embodiment, audio signals are supplied to the AV amplifier 300 via the cables 141–144 that extend from the body 11 and the pin plugs 141T–144T as the output terminals that are provided at the tips of the cables 141–144.

Therefore, there does not occur a case that the connector portions of connection cables that are connected to the audio signal output terminals provided on the body 1 of the adaptor 10 (first embodiment) protrude from the body 1 and obstruct other terminals or switches in the vicinity of the EURO SCART terminal of a television receiver or a VTR.

Embodiment 3

Next, a connector according to a second embodiment of the invention will be described. The connector that will be described below also conforms to what is called the EURO SCART terminal.

Figure 9:
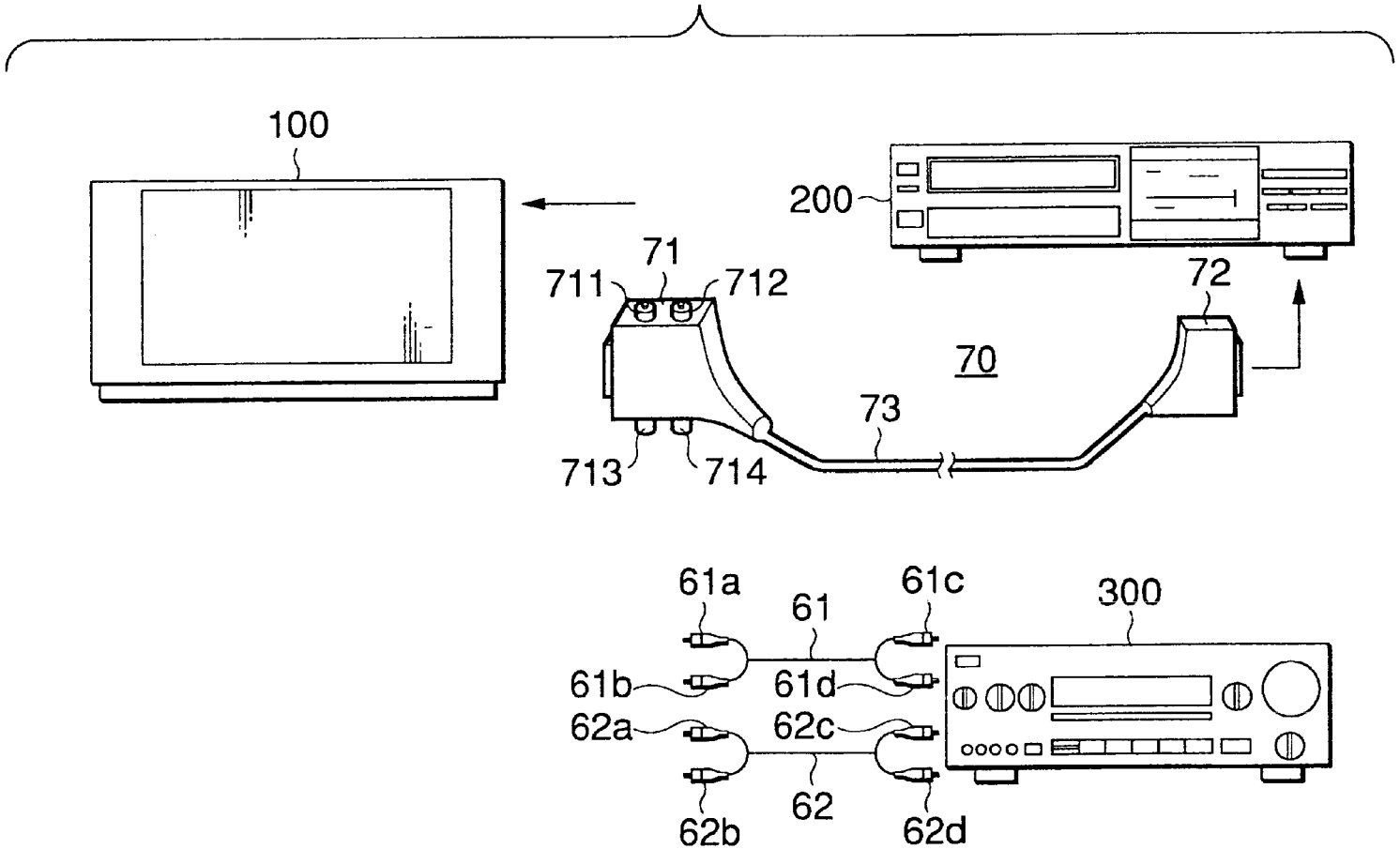
FIG. 9 shows a connector according to a third embodiment of the invention and also shows how AV apparatuses are connected to each other by using this connector.

FIG. 9 shows the connector of this embodiment. As shown in FIG. 9, a connector 70 of this embodiment is composed of plug portions 71 and 72 that are to fit in the EURO SCART terminal units provided in a television receiver 100 and a VTR 200, respectively, and a cable 73 for connecting the plug portions 71 and 72. The one plug portion 71 is formed with pin jacks 711–714 that can supply, to an AV amplifier 300, audio signals that are output from the television receiver 100 or the VTR 200.

In the third embodiment, as shown in FIG. 9, the television receiver 100 and the VTR 200 are connected to each other such that the plug portion 71 is fitted in the EURO SCART terminal unit of the television receiver 100 and the plug portion 72 is fitted in the EURO SCART terminal unit of the VTR 200.

With the above connections, as shown in FIG. 1, all of signals to be handled by the 21 respective contact pieces can be input or output via the connector 70 between the television receiver 100 and the VTR 200.

In the third embodiment, plug contact pieces 201–221 and jack contact pieces 301–321, etc. of the EURO SCART terminal are the same as those in the first embodiment. The pin jacks 711–714 for outputting audio signals are provided on the body of the plug portion 71 so as to be connected to the contact pieces for handling audio signals in the body of the plug portion 71 in the same manner as the pin jacks 41–44, respectively, of the adaptor 10 of the first embodiment that were described above in connection with FIG. 3.

That is, the pin jack 711 is connected to the contact pieces for handling a left (L) channel audio signal among stereo audio signals to be output from the television receiver. The pin jack 712 is connected to the contact pieces for handling a right (R) channel audio signal among stereo audio signals to be output from the television receiver.

The pin jack 713 is connected to the contact pieces for handling a left (L) channel audio signal among stereo audio signals to be supplied from the VTR to the television receiver. The pin jack 714 is connected to the contact pieces for handling a right (R) channel audio signal among stereo audio signals to be supplied from the VTR to the television receiver.

With the above connections, in the third embodiment, the audio signal output pin jacks 711–714 that are provided in the plug portion 71 output stereo audio signals of the left (L) and right (R) channels that are output from the television receiver and stereo audio signals of the left (L) and right (R) channels that are output from the VTR.

As shown in FIG. 9, the audio signal output pin jacks 711–714 of the plug portion 71 of the connector 70 are connected to the audio input pin jacks of the AV amplifier 300 by using connection cables 61 and 62 having pin plugs at both ends, whereby audio signals that are output from each of the television receiver 100 and the VTR 200 that are connected to each other via the connector 70 can be supplied to the AV amplifier 300.

Where the EURO SCART terminal unit provided in each of the television receiver 100 and the VTR 200 is configured in plug form, connector jack structures with a contact piece layout obtained by removing the pin plugs 42 and 44 from the jack portion 3 shown in FIG. 2C are employed in place of the plug portions 71 and 72.

By using the connector 70 of this embodiment in the above manner, audio signals that are output from each of the television receiver 100 and the VTR 200 which are connected to each other with the EURO SCART terminals can be supplied to the AV amplifier 300, thereby enabling external speakers such as surround speakers that are connected to the AV amplifier 300 to output sound.

As described above, the connector 70 of the third embodiment allows the television receiver 100 and the VTR 200, each having what is called the EURO SCART terminal unit, to be connected to each other by using the EURO SCART terminals without impairing the functions of the EURO SCART terminals, as well as allows the AV amplifier 300 to be connected between the TV receiver 100 and the VTR 200.

Therefore, as in the case of using the above-described adaptors 10 and 20 of the first and second embodiments, the invention eliminates complexity in the connections of a connection cable for connecting the apparatuses concerned, which require undue time and labor for the connections and where associated signals cannot be input or output to disable the apparatuses concerned to be controlled in link with each other. That is, it becomes possible to connect electronic apparatuses such as a television receiver, a VTR, and an AV amplifier by using EURO SCART terminals without impairing the functions of the EURO SCART terminals.

Although in the third embodiment the audio signal output pin jacks 711–714 are provided on the body of the plug portion 71, the invention is not limited to such a structure.

That is, as in the case of the adaptor 20 of the second embodiment, cables that are connected to the contact pieces for handling audio signals may be provided so as to extend outward from the body of the plug portion 71 and pin jacks may be provided at the tips of the extended cables.

Although the adaptors 10 and 20 and the connector 70 according to the first to third embodiments have been described above as conforming to what is called the EURO SCART terminal that is a 21-contact-piece terminal for Europe, the invention is not limited to such a case. That is, the adaptor and the connector according to the invention may be configured to conform to multiple-contact-piece terminals according to other standards.

Although the first to third embodiments were directed to the case where an AV amplifier is connected between a television receiver and a VTR, the invention is not limited to such a case. For example, only audio signals can be supplied to an AV amplifier in a case where a television receiver is connected to such an AV apparatus as a DVD (digital video disc) recording/reproduction apparatus or a LD (laser disc) reproduction apparatus.

Further, the pin jacks that are provided on the body of the adaptor or the connector are not limited to those for audio signal output. Naturally they may be provided for the purpose of input/output of signals to be led out to the outside. Pin plugs, rather than the pin jacks, may be provided on the body.

As described above, according to the adaptor and the connector of the invention, all signals that are handled by a multiple-contact-piece terminal can be input and output as well as necessary signals can be extracted separately.

As a result, all signals that should be input and output with the multiple-contact-piece terminal can be input and output without impairing those signals, as well as another AV apparatus can be connected between the AV apparatuses that are connected by the multiple-contact-piece terminal.

What is claimed is:

1. An adapter to be placed between a first terminal corresponding to a first device and a second terminal corresponding to a second device, each terminal having multiple contacts for inputting/outputting at least one of a video signal and an audio signal, the adaptor comprising:

a first connecting portion having multiple contacts for mechanically and electrically connecting the first terminal with the first device;

a second connecting portion having multiple contacts for mechanically and electrically connecting the second terminal with the second device, wherein the multiple contacts in the second connecting portion are connected to respective multiple contacts in the first connecting portion;

a conductive contact piece connected to a predetermined contact out of the multiple contacts in the first and second connecting portions, wherein the conductive contact piece is mechanically and electrically connectable with a third device; and wherein the conductive contact piece is formed either on a body portion of the adaptor or at an end of a cable that is mechanically and electrically connected to the predetermined contact, wherein the cable extends outward from a body portion of the adaptor, and wherein the first, second and third devices connected by the adaptor are a television receiver, a video tape recorder, and an AV amplifier.

2. The adapter according to claim 1, wherein the conductive contact piece is an audio signal output terminal.

3. The connector according to claim 1, wherein the conductive contact piece connects with a pin plug or a pin jack in the third device.

4. A multiple contact for connectors for inputting/outputting at least one of a video signal and an audio signal, the connector comprising:

a plug portion having multiple contacts for mechanically and electrically coupling to a first device;

a jack portion having multiple contacts for mechanically and electrically coupling to a second device;

a cable portion having a plurality of signal lines that are mechanically and electrically connected to the respective multiple contacts in the plug portion or the jack portion;

a conductive contact piece connected to a predetermined contact out of the multiple contacts in the plug portion or jack portion, wherein the conductive contact piece is mechanically and electrically connectable with a third device; and wherein the conductive contact piece is formed either on a body portion of the connector or at an end of a cable that is connected to the predetermined contact, wherein the cable extends outward from a body portion of the connector, and wherein the first, second and third devices connected by the multiple-contact connector are a television receiver, a video tape recorder, and an AV amplifier.

5. The connector according to claim 4, wherein the conductive contact piece is an audio signal output terminal.

6. A multiple contact connector to claim 4, wherein the conductive contact piece connects with a pin plug or a pin jack in the third device. inputting/outputting at least one of a video signal and an audio signal, the connector comprising:

a plug portion having multiple contacts for mechanically and electrically coupling to a first device;

a jack portion having multiple contacts for mechanically and electrically coupling to a second device;

a cable portion having a plurality of signal lines that are mechanically and electrically connected to the respective multiple contacts in the plug portion or the jack portion;

a conductive contact piece connected to a predetermined contact out of the multiple contacts in the plug portion or jack portion, wherein the conductive contact piece is mechanically and electrically connectable with a device; and wherein the conductive contact piece is formed on a body portion of the connector.

7. An adapter comprising:

a first connector, a second connector and a plurality of third connectors, said first connector having a first connecting portion, said first connecting portion having a plurality of first contacts, said plurality of first contacts including a plurality of first audio contacts and a plurality of first video contacts, said second connector having a second connecting portion, said second connecting portion having a plurality of second contacts, said plurality of second contacts including a plurality of second audio contacts and a plurality of second video contacts, and a third connector of said plurality of third connectors being in electrical contact with a first contact of said plurality of first contacts and in electrical contact with a second contact of said plurality of second contacts.

8. The adapter according to claim 7, wherein said first audio contact of said plurality of first audio contacts and a second audio contact of said plurality of second audio contacts conduct an audio signal.

9. The adapter according to claim 7, wherein said first video contact of said plurality of first video contacts and a second video contact of said plurality of second video contacts conduct a video signal.

10. The adapter according to claim 7, wherein said first audio contact of said plurality of first audio contacts and a second audio contact of said plurality of second audio contacts conduct an audio signal, and said first video contact of said plurality of first video contacts and a second video contact of said plurality of second video contacts conduct a video signal.

11. The adapter according to claim 7, wherein a first contact of said plurality of first contacts is in electrical connection with a corresponding second contact of said plurality of second contacts.

12. The adapter according to claim 7, wherein said third connector is in electrical contact with a first audio contact of said plurality of first audio contacts and is in electrical connection with a second audio contact of said plurality of second audio contacts.

13. The adapter according to claim 7, wherein a first audio contact of said plurality of first audio contacts is in electrical connection with a corresponding second audio contact of said plurality of second audio contacts.

14. The adapter according to claim 7, wherein a first video contact of said plurality of first video contacts is in electrical connection with a corresponding second video contact of said plurality of second video contacts.

15. The adapter according to claim 7, wherein a first audio contact of said plurality of first audio contacts is in electrical connection with a corresponding second audio contact of said plurality of second audio contacts, and a first video contact of said plurality of first video contacts is in electrical connection with a corresponding second video contact of said plurality of second video contacts.

16. The adapter according to claim 15, wherein said thrid connector is in electrical contact with said first audio contact and said second audio contact.

17. The adapter according to claim 7, wherein said first connecting portion is a plug portion.

18. The adapter according to claim 7, wherein said second connecting portion is a jack portion.

19. The adapter according to claim 7, wherein said first connecting portion is a plug portion, and said second connecting portion is a jack portion.

20. The adapter according to claim 7, wherein said first connecting portion mechanically and electrically connects said adaptor with a first device.

21. The adapter according to claim 20, wherein said first device processes at least one of an audio signal and a video signal.

22. The adapter according to claim 7, wherein said plurality of first audio contacts include a common audio contact.

23. The adapter according to claim 7, wherein a first audio contact of said plurality of first audio contacts conducts an audio signal.

24. The adapter according to claim 7, wherein a first video contact of said plurality of first video contacts conducts a video signal.

25. The adapter according to claim 7, wherein said second connecting portion mechanically and electrically connects said adaptor with a second device.

26. The adapter according to claim 25, wherein said second device processes at least one of an audio signal and a video signal.

27. The adapter according to claim 7, wherein a second audio contact of said plurality of second audio contacts conducts an audio signal.

28. The adapter according to claim 7, wherein a second video contact of said plurality of second audio contacts conducts a video signal.

29. The adapter according to claim 7, wherein a third connector of said plurality of third connectors conducts an audio signal.

30. The adapter according to claim 7, wherein a third connector of said plurality of third connectors is a plug.

31. The adapter according to claim 30, wherein said plug is a pin plug.

32. The adapter according to claim 7, wherein a third connector of said plurality of third connectors is a jack.

33. The adapter according to claim 32, wherein said jack is a pin jack.

34. The adapter according to claim 7, wherein said third connector mechanically and electrically connects said adaptor with a third device.

35. The adapter according to claim 34, wherein said third device processes an audio signal.

36. The adapter according to claim 7, wherein said adaptor has an adaptor body.

37. The adapter according to claim 36, wherein said second connector is disposed on said adaptor body.

38. The adapter according to claim 36, wherein said second connector is disposed at a distal end of a cable, said proximal end of said cable being in contact with said adaptor body.

39. The adapter according to claim 38, wherein said first connector and said plurality of third connectors are disposed on said adaptor body.

40. The adapter according to claim 36, wherein said third connector is disposed on said adaptor body.

41. The adapter according to claim 36, wherein said plurality of third connectors is disposed on said adaptor body.

42. The adapter according to claim 36, wherein said plurality of third connectors is disposed at a distal end of a cable, said proximal end of said cable being in contact with said adaptor body.

43. The adapter according to claim 42, wherein said first connector and said second second connector are disposed on said adaptor body.

44. The adapter according to claim 36, wherein said third connector is disposed at a distal end of a cable, said proximal end of said cable being in contact with said adaptor body.

45. The adapter according to claim 44, wherein said first connector and said second connector are disposed on said adaptor body.

* * * * *

UNITED STATES PATENT AND TRADEMARK OFFICE

CERTIFICATE OF CORRECTION

PATENT NO. : 6,503,104 B1
DATED : January 7, 2003
INVENTOR(S) : Tetsuo Yuga

It is certified that error appears in the above-identified patent and that said Letters Patent is hereby corrected as shown below:

Column 12,
Line 13, "inputting/outputting at least one of" should be deleted.
Lines 14 to 30, should be deleted.

Column 13,
Line 21, "thrid" should read -- third --.

Column 14,
Line 5, "audio" should read -- video --.

Signed and Sealed this

Twenty-eighth Day of December, 2004

JON W. DUDAS
*Director of the United States Patent and Trademark Office*